US006276616B1

(12) United States Patent
Jenkins

(10) Patent No.: US 6,276,616 B1
(45) Date of Patent: Aug. 21, 2001

(54) FLUID NEEDLE LOADING ASSEMBLY FOR AN AIRLESS SPRAY PAINT GUN

(75) Inventor: Jason R. Jenkins, Boulder, CO (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/545,818

(22) Filed: Apr. 7, 2000

(51) Int. Cl.[7] ..... B05B 7/02

(52) U.S. Cl. ..... 239/526; 239/583; 239/600; 239/DIG. 14; 251/335.2

(58) Field of Search ..... 239/525, 526, 239/583, 600, DIG. 14; 251/335.1, 335.2; 222/518

(56) References Cited

U.S. PATENT DOCUMENTS

| | | | | |
|---|---|---|---|---|
| 1,969,205 | * | 8/1934 | Carr et al. | 239/DIG. 14 X |
| 3,633,828 | * | 1/1972 | Larson | 239/DIG. 14 X |
| 4,245,784 | | 1/1981 | Garcin . | |
| 4,560,109 | * | 12/1985 | Teruyuki et al. | 239/583 |
| 4,572,438 | | 2/1986 | Traylor . | |
| 4,713,257 | | 12/1987 | Luttermoller . | |
| 4,750,676 | | 6/1988 | Huber et al. . | |
| 5,615,804 | * | 4/1997 | Brown | 222/518 X |
| 5,669,557 | * | 9/1997 | Barrett et al. | 239/DIG. 14 X |
| 5,695,120 | * | 12/1997 | Kingsford | 251/335.2 X |
| 5,725,161 | | 3/1998 | Hartle . | |
| 5,803,372 | | 9/1998 | Weinstein et al. . | |

FOREIGN PATENT DOCUMENTS

| | | |
|---|---|---|
| 972949 | 8/1975 | (CA) . |

* cited by examiner

*Primary Examiner*—David A. Scherbel
*Assistant Examiner*—Steven J. Ganey
(74) *Attorney, Agent, or Firm*—Pitney, Hardin, Kipp & Szuch LLP

(57) ABSTRACT

An airless spray gun having a gun body and in the gun body a first internal passageway for fluid under pressure to flow to a discharge nozzle, a valve in this passageway for adjusting the flow rate of the fluid and a valve stem for actuating the valve, where the valve stem extends through a second internal passageway, the gun further including a spring biasing the valve stem in a downstream direction to close the valve and a trigger for moving the valve stem in the upstream direction to open the valve, the first passageway intersecting the second passageway downstream of the spring and upstream of the valve.

20 Claims, 3 Drawing Sheets

FLUID NEEDLE LOADING ASSEMBLY FOR AN AIRLESS SPRAY PAINT GUN

BACKGROUND OF THE INVENTION

1. Field of the Invention

The present invention relates to spray guns for paint and other the liquids and particularly to airless or hydrostatic atomization types of spray guns.

2. Description of the Prior Art

Typical spray guns of the airless or hydrostatic type, as exemplified by U.S. Pat. No. 4,245,784, eject the fluid through at least one central channel of a discharge nozzle where the fluid is atomized into particles which are sprayed in a conical or fan shaped pattern. In some spray guns the fluid passageway or passageways are directed tangentially into a circular chamber situated immediately upstream of the discharge nozzle to impose a circular or whirling motion around the discharge axis of the spray pattern. In other spray guns the fluid is electrostatically charged at the time the spray pattern is established, as seen in additional prior art references, Canadian patent Nos. 965,943 of Patrick D. Shaffer and 972,949 assigned to Graco, Inc.

A typical airless spray gun has a pistol grip handle including a trigger and valve for controlling liquid flow and an adjustment element for varying the spray patterns and/or the degree of atomization. Such a spray gun has a principal fluid flow passage leading to the discharge nozzle, with a needle valve stem situated centrally in this passage and terminating in a ball or other valve closure element that engages a valve seat. A helical coil spring is situated within this fluid flow passage and surrounding the valve stem for biasing the valve to a closed position unless and until it is opened by the trigger.

Additional prior art references illustrating various spray guns include U.S. Pat. No. 4,572,438 to Traylor, U.S. Pat. No. 4,713,257 to Luttermoller, U.S. Pat. No. 4,750,676 to Huber, et al., U.S. Pat. No. 5,725,161 to Hartle, and U.S. Pat. No. 5,803,372 to Weinstein, et al.

While spray guns of these types are well known and relatively successful, they have various drawbacks as follows. Firstly, the spring and needle valve stem reside in the fluid flow passage where paint particles of the flowing fluid can dry and jam the apparatus or later become dislodged and bleed into subsequently used paint of a different color, or flake off and clog the discharge nozzle. Secondly, the basic or typical airless spray gun has a considerable number of components in a relatively complex assembly, such that it is quite difficult and time consuming for users to maintain and/or disassemble and repair the apparatus.

OBJECTS AND SUMMARY OF THE INVENTION

The new invention provides an airless spray gun with a needle loading assembly, which might also be called valve stem mounting assembly, that is easily and very quickly removable and/or replaceable, and furthermore is easy and economical to manufacture. This has been achieved by the design of a removable assembly formed as a cartridge that includes a housing, the valve stem, a spring sub-assembly for biasing the stem in the downstream direction, a valve seal element at the distal end of the valve stem, and a U-cup fluid seal element downstream of the spring to prevent fluid from reaching the area of the spring and the portion of the valve stem surrounded by the spring.

In the spray gun of the new invention the entire cartridge assembly is removed by a simple unscrewing phase and then repaired or replaced. Obviously, reassembly is essentially as easy as disassembly. It has been found that the entire disassembly can be accomplished with two adjustable wrenches in about 90 seconds, which is a great advantage over prior art spray guns.

This ability to disassemble so easily and quickly has been achieved in large part because of the simplicity incorporated into the design of this removable cartridge, and this is made possible because the paint or other fluid no longer travels along the needle valve stem and the adjacent spring. As seen in the attached drawings of a preferred embodiment of this invention, the liquid flow path is directed to a chamber downstream of the area where the valve stem is engaged by the spring. A seal adjacent and upstream of this chamber bars fluid from flowing upstream to the area of the spring, the chamber surrounding the spring and the portion of the valve stem surrounded by the spring. Also with this design the location along the length of the valve stem of engagement with the spring is still relatively near the distal end of the stem which engages and seals with the valve seat. In spray guns where the spring engages the valve stem at a great distance from the sealing end there is substantially greater risk of bending or breaking the stem. Thus, this design retains the benefit of applying a spring force relatively close to the valve, while not exposing the spring and associated parts to the paint itself.

It is thus an object of this invention to make disassembly, cleaning, repair, and reassembly very easy and quick, and to provide a needle valve stem and spring subassembly that is easy and economical to manufacture.

An additional object is to provide an airless spray gun where the paint or the fluid to be sprayed is detoured away from the spring, the needle valve stem and the surrounding chamber.

The present invention is believed to be applicable to various types of spray guns besides airless, including gravity feed, suction feed and pressure feed, and to electrostatically charged spray guns. In all these applications the spray fluid is directed to the downstream portion of the needle valve stem instead of to the upstream part and along the length of the stem.

DETAILED DESCRIPTION OF THE PREFERRED EMBODIMENT

Figure 1:
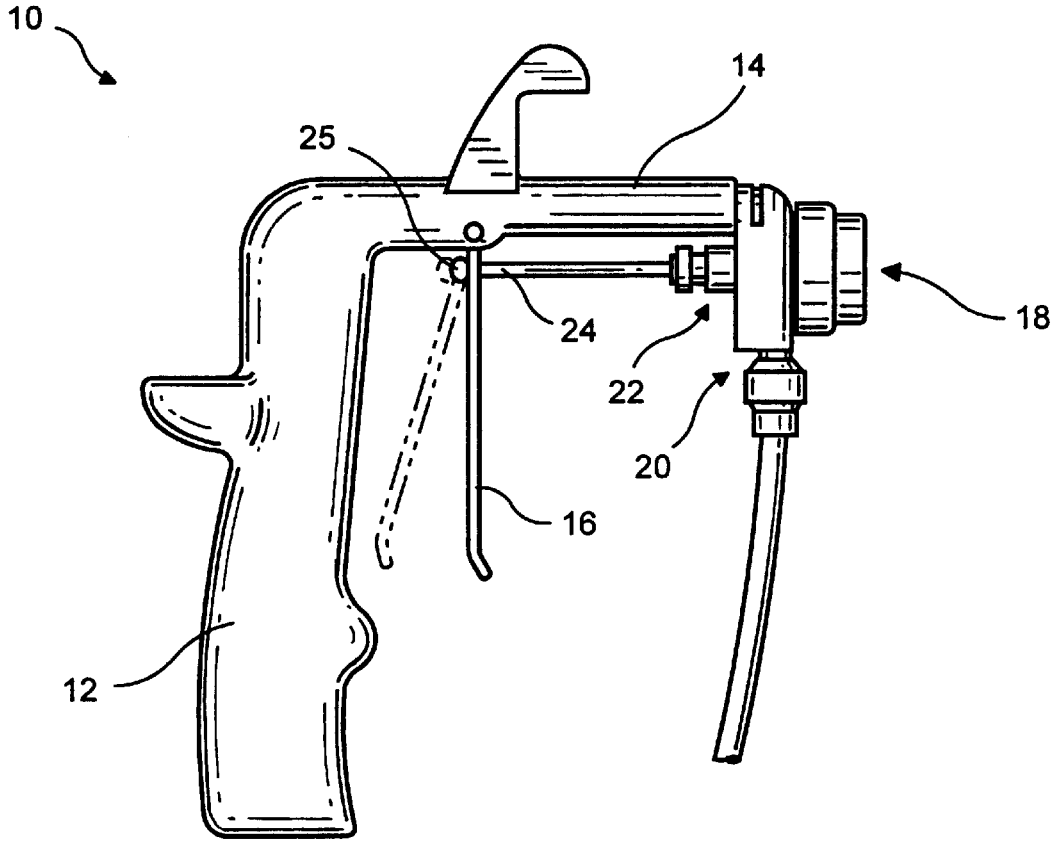
FIG. 1 is a schematic elevation view of an airless spray gun.
Figure 2:
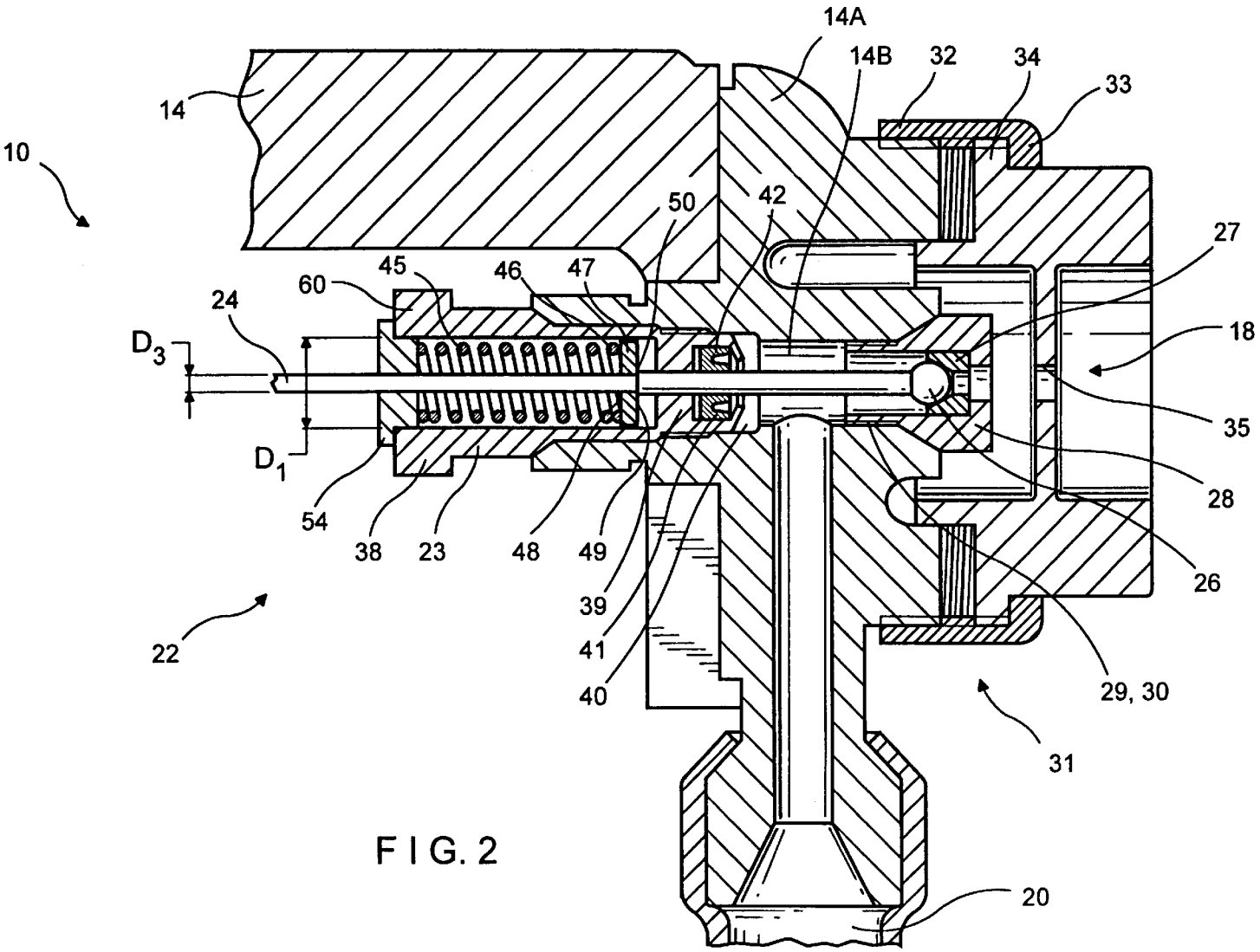
FIG. 2 is a fragmentary elevation view in enlarged cross-section of a removable cartridge needle loading assembly for an airless spray gun, with the valve shown in closed position.
Figure 3:
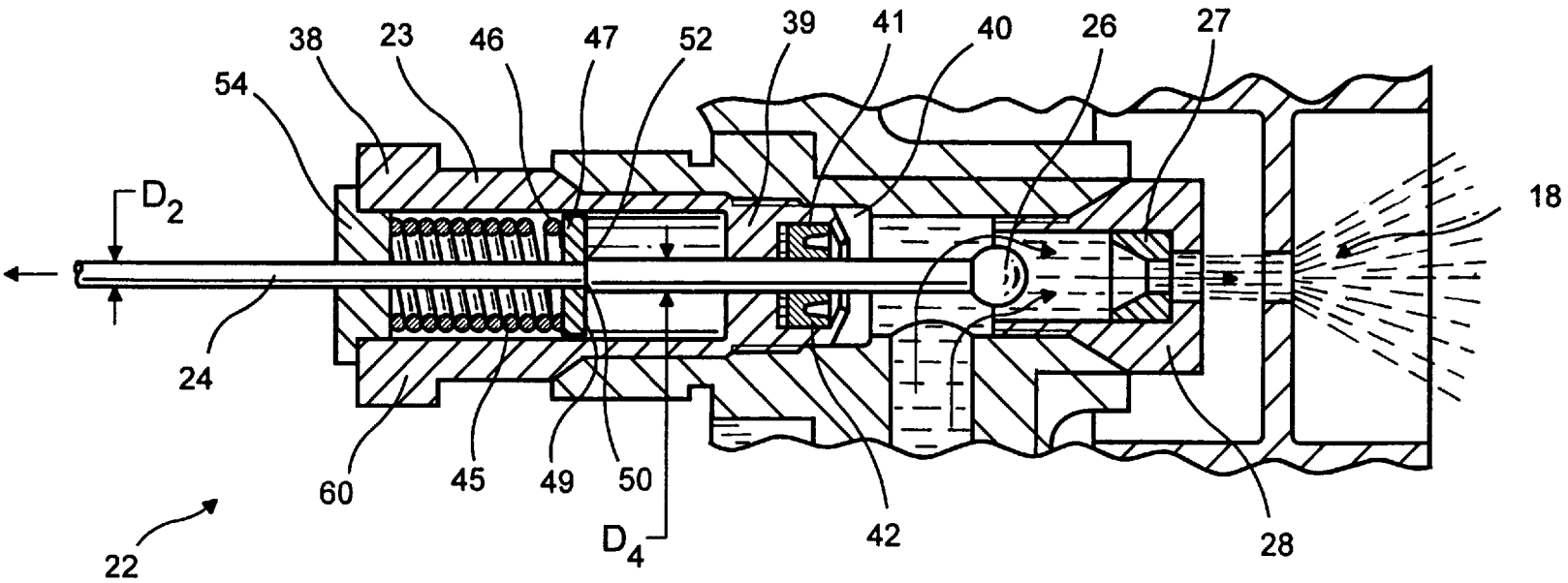
FIG. 3 is a fragmentary top plan view of the removable cartridge needle loading assembly of FIG. 2, with the valve shown in open position.

FIGS. 1–3 show an airless spray gun 10 having handle 12, barrel 14, forward housing 14A including fluid inlet passage 20 from a source (not shown) of fluid under pressure and air passage 14B, trigger 16, discharge nozzle 18, and a fluid needle loading assembly 22. This assembly 22 is a removable cartridge comprising a housing 23, a valve stem 24, a coupling 25 at the proximal end of valve stem 24 for engaging trigger 16, and a valve seal element 26 for engaging and sealing with valve seat 27. Usually, the valve seal element 26 is spherical and operable with a conical valve seat 27 as shown; however the valve seal element is not necessarily spherical and may have other shapes. The seal element 26 and valve seat 27 may be made of specially selected wear-resistant materials well known in the prior art and replaceable if eventually damaged or worn. The valve seat element 27 is secured to an annular holder 28 which is removably coupled to the forward housing 14A by threaded portions 29 and 30 respectively. The nozzle 18 can be easily removed and cleaned or replaced by unscrewing union nut 31 whose proximal end 32 threadedly engages forward housing 14A and whose distal end 33 engages shoulder 34 of the nozzle 18. The nozzle, obviously, can be selected to have wall 35 of varying axial length, aperture diameter and other characteristics, known in the prior art.

As seen in FIGS. 2 and 3 the removable cartridge or needle valve stem assembly 22 is formed as a cylindrical housing 23 having a proximal part 38 with a first bore diameter D1, a distal part 39 and terminal end 40. Between parts 39 and 40 is a recess 41 formed as a radially outwardly extending annular cavity to receive and hold flexible seal element 42 which has a U-cup cross-section.

Also within the needle valve stem assembly 22 is a helical coil spring 45 for urging valve stem 24 in the downstream direction (to the right in FIGS. 2 and 3), so that its valve seal element 26 tightly engages valve seat 27. The spring 45 occupies the cylindrical chamber having diameter D1 and has a distal end 46 that bears against needle shuttle or collar 47 which has an upstream surface 48 against which the spring end 46 bears, urging same in the downstream direction. Shuttle 47 has a downstream surface 49 with an inner edge 50 (seen in FIG. 3) which will engages the valve stem as explained below.

Needle valve stem 24 has a proximal part of first diameter D3 and a distal part of larger diameter D4 and has between said proximal and distal parts a transition area formed as a tapered shoulder 52 (marked in FIG. 3). As seen FIGS. 2 and 3, shuttle 47 has a downstream surface 49 which bears against said shoulder 52. Spring 45 applies force in the downstream direction against shuttle 47 whose downstream surface engages and urges shoulder 52, thereby urging the valve stem 24 to the right and thence urges its seal element 26 to seat and seal in valve seat 27.

The proximal end of spring 45 is restrained by end cap 54 which is secured to the proximal end of housing/cartridge 23. This cap is preferably pressed and crimped permanently into the proximal end; however, in an alternative construction it could be threadedly engaged. A variety of other coupling means could be used to restrain this proximal end of the spring; also other types of springs both internal and external could be used to apply the downstream force on the valve stem.

The new spray gun of this invention creates a liquid spray in a usual manner, as exemplified by numerous of the prior art references cited above and incorporated herein by reference. The novelty in the present invention is the new structure which prevents clogging of relevant parts and permits very swift and easy disassembly, cleaning, repair and re-assembly. Accordingly, the user applies a wrench to nut surface 60 by which the cartridge housing may be threadedly removed. Coupling 25 at the left end of valve stem 24 should be disengaged from the trigger or other actuator that might be used. Then the valve stem 24 can be removed in the downstream direction from the housing 23 and replaced, especially if the seal element 26 is worn or damaged. Also, when the valve stem is removed the seal 42 can be easily replaced. As noted earlier, unscrewing nut 31 will release nozzle 18 for replacement, if desired. Valve seat and annular tip 28 comprise a unit that can be removed and replaced. In the simplest operation, housing 23 is unscrewed with the other aspects of disassembly being optional.

Within the scope of this invention numerous structural variations are readily possible. The valve stem can be spring loaded and biased in the downstream direction without the specifically shown transition area or shoulder area between the lead and the tail parts of this stem. Also, the spring can take various forms and shapes which engage the valve stem. The U-cup seal 42 may be replaced by seals of many shapes and materials, including natural and synthetic rubber, plastic and many fiber gasket materials known in this art. The seal surface at the terminal end of the valve stem may have spherical, conical, or other shapes, and the material of this surface and of the valve seat will be chosen from many possibilities well known in the art. The remaining components of this spray gun are made from metal or plastic and by manufacturing techniques well known in the art.

As mentioned above, the novelty of the present invention may be applied to both airless and other traditional spray guns. Accordingly, one could optionally incorporate in the structure shown an air passage directing a high pressure air flow to an area downstream of the valve where such flow could by suction draw the paint or other fluid out into the desired spray.

Thus, while the invention has been described in connection with a preferred embodiment, those skilled in the art will recognize possible variations in structure and materials which can be used in the practice of the invention. The invention is therefore intended to be limited only by the scope of the claims appended hereto.

What is claimed is:

1. An airless spray gun operable with a source of fluid under hydrostatic pressure, comprising a gun body which defines therein a first passageway including a first inlet and an outlet for flow of said fluid therethrough, and a second passageway which has a second inlet and communicates with said first passageway, a valve upstream of said outlet in said first passageway, a valve stem having a lead part for actuating said valve and a tail part upstream of said lead part, and a valve stem mounting assembly comprising a housing removably secured in said second passageway, said housing having a tail part and a lead part downstream of said tail part and a bore centrally located along its length, said housing further comprising a spring engaging and urging said tail part of said valve stem in the downstream direction for closing said valve, an annular seal engaging and establishing a fluid seal between said lead part of said valve stem and said spring, wherein length of the valve stem downstream of said annular seal is less than the length of the valve stem upstream of said annular seal; and an actuator coupled to said valve stem for moving same in the upstream direction to open said valve, said first passageway intersecting said second passageway only downstream of said seal and upstream of said valve.

2. Apparatus according to claim 1 wherein said housing comprises a cylinder having external threads on an outer surface thereof, and said second internal passage in said gun body defines a bore with internal threads to which said external threads are releasably coupled.

3. Apparatus according to claim 1 wherein said housing comprises a cylinder with a bore centrally located along its length, said valve stem is situated generally coaxially in said bore, and said spring is a coil spring generally coaxial with said bore and said valve stem.

4. Apparatus according to claim 1 wherein said valve comprises a valve seat and a valve seal element releasably engaged to said valve seat, said valve seat being mounted to said gun body and said valve seal element being mounted to said downstream part of said valve stem.

5. An airless spray gun comprising a gun body which includes a first inlet for receiving fluid under pressure, an outlet for discharge of said fluid, a first internal passage communicating said first inlet with said outlet, and a second inlet and a second internal passage extending from said second inlet to said outlet, said spray gun further comprising a valve upstream of said outlet to control flow of said fluid to said outlet, a valve stem for actuating said valve, and a valve stem mounting assembly comprising a housing inserted via said second inlet into said second internal passage and releasably secured therein, said housing having a bore, said valve stem having a tail part, a lead part downstream of said tail part and a spring-engaging part between said tail and lead parts, at least portions of said tail and said lead parts of said valve stem situated in said bore of said housing, a coil spring surrounding a portion of said tail part in said bore of said housing, said coil spring having a tail part coupled to said housing and a lead part coupled to said spring-engaging part of said valve stem for urging same in the downstream direction for biasing said valve to a closed state, an actuator mounted on said housing and coupled to said tail part of said valve stem for moving same in the upstream direction to selectively open said valve, an annular seal slidably mounted on said lead part of said valve stem downstream of said spring-engaging part and establishing a seal between said lead part of said valve stem and said spring wherein length of the valve stem downstream of said annular seal is less than the length of the valve stem upstream of said annular seal, said first internal passage communicating with said second internal passage only downstream of said seal and upstream of said valve.

6. Apparatus according to claim 5 wherein said housing comprises a cylinder having external threads on an outer surface thereof, and said second internal passage in said gun body defines a bore with internal threads to which said external threads are releasably coupled.

7. Apparatus according to claim 5 wherein said housing comprises a cylinder with a bore centrally located along its length, said valve stem is situated generally coaxially in said bore, and said coil spring is generally coaxial with said central bore and said valve stem.

8. Apparatus according to claim 5 wherein said valve stem has a downstream end adjacent said valve, and said valve comprises a valve seat and a valve seal element releasably engaged to said valve seat, said valve seat being mounted to said gun body and said valve seal element being mounted to said downstream end of said valve stem.

9. Apparatus according to claim 5 wherein said valve comprises a valve seat secured in said first internal passage, and said valve stem's lead part terminates in a sealing surface for engagement with said valve seat.

10. An airless spray gun comprising a gun body which includes a first inlet for receiving fluid under pressure, an outlet for discharge of said fluid, a first internal passage communicating said first inlet with said outlet, and a second inlet and a second internal passage extending from said second inlet to said outlet, said spray gun further comprising a valve upstream of said outlet to control flow of said fluid to said outlet, a valve stem for actuating said valve, and a valve stem mounting assembly comprising a housing inserted via said second inlet into said second internal passage and releasably secured therein, said housing having a bore, said valve stem having a tail part, a lead part downstream of said tail part and a spring-engaging part between said tail and lead parts, wherein said valve stem's tail part has a first diameter and said lead part has a second diameter greater than said first diameter with a transitional shoulder area between said tail and lead parts, at least portions of said tail and said lead parts of said valve stem situated in said bore of said housing, a coil spring surrounding a portion of said tail part in said bore of said housing, said coil spring having a tail part coupled to said housing and a lead part coupled to said transitional shoulder area for urging said valve stem in the downstream direction for biasing said valve to a closed state, an actuator mounted on said housing and coupled to said tail part of said valve stem for moving same in the upstream direction to selectively open said valve, an annular seal slidably mounted on said lead part of said valve stem downstream of said spring-engaging part and establishing a seal between said lead part of said valve stem and said bore of said housing, said first internal passage communicating with said second internal passage only downstream of said seal and upstream of said valve.

11. Apparatus according to claim 10 wherein said assembly further comprises a shuttle formed as a collar situated between said engaging said lead end of said coil spring and said transitional shoulder area of said valve stem.

12. Apparatus according to claim 11 wherein said shuttle has an outer diameter at least as great as that of said coil spring and has a bore through which said valve stem extends, where said shuttle bore diameter is smaller than the maximum diameter of said transitional shoulder area.

13. An airless spray gun comprising a gun body which includes a first inlet for receiving fluid under pressure, an outlet for discharge of said fluid, a first internal passage communicating with said first inlet with said outlet, and a second inlet and a second internal passage extending from said second inlet to said outlet, said spray gun further comprising a valve upstream of said outlet to control flow of said fluid to said outlet, a valve stem for actuating said valve, and a valve stem mounting assembly comprising a housing inserted via said second inlet into said second internal passage and releasably secured therein, said housing comprises a cylinder with a lead part and a tail part upstream of said lead part and a bore centrally located therethrough, and a first annular recess extending radially outward of said bore in said lead part of said housing and a second annular recess extending radially outward of said bore in said tail part of said housing, said valve stem having a tail part, a lead part downstream of said tail part and a spring-engaging part between said tail and lead parts, at least portions of said tail and said lead parts of said valve stem situated in said bore of said housing, a coil spring situated in said second recess, said coil spring surrounding a portion of said tail part in said bore of said housing, said coil spring having a tail part coupled to said housing and a lead part coupled to said spring-engaging part of said valve stem for urging same in the downstream direction for biasing said valve to a closed state, an actuator mounted on said housing and coupled to said tail part of said valve stem for moving same in the upstream direction to selectively open said valve, an annular seal slidably mounted on said lead part of said valve stem downstream of said spring-engaging part and situated in said first recess said annular seal establishing a seal between said lead part of said valve stem and said bore of said housing, said first internal passage communicating with said second internal passage only downstream of said seal and upstream of said valve.

14. Apparatus according to claim 13 wherein said seal is an annular ring having a U-shape cross-section, where this U-shape cross-section is situated horizontally with the open end of the U facing downstream.

15. Apparatus according to claim 14 wherein said housing further comprises in said first annular recess downstream and adjacent said seal, a U-cup protector formed as an annular ring through which said lead part of said valve stem extends.

16. Apparatus according to claim 13 wherein said housing tail part has an upstream end, and said housing further comprise a plug that threadedly engages said upstream end of said tail part securing the tail end of said coil spring in said second annular recess.

17. An airless spray gun comprising a gun body which includes a first inlet for receiving fluid under pressure, an outlet for discharge of said fluid, a first internal passage communicating said first inlet with said outlet, and a second inlet and a second internal passage extending from said second inlet to said outlet, said spray gun further comprising a valve upstream of said outlet to control flow of said fluid to said outlet said valve comprises a valve seat and a valve seal element releasably engaged to said valve seat said valve seat being mounted to said gun body, a valve stem for actuating said valve a downstream end of said valve stem securing said valve element, and a valve stem mounting assembly comprising a housing inserted via said second inlet into said second internal passage and releasably secured therein, said housing having a bore, said valve stem having a tail part, a lead part downstream of said tail part, a spring-engaging part between said tail and lead parts downstream end adjacent to said valve, at least portions of said tail and said lead parts of said valve stem situated in said bore of said housing, a coil spring surrounding a portion of said tail part in said bore of said housing, said coil spring having a tail part coupled to said housing and a lead part coupled to said spring-engaging part of said valve stem for urging same in the downstream direction for biasing said valve to a closed state, an actuator mounted on said housing and coupled to said tail part of said valve stem for moving same in the upstream direction to selectively open said valve, an annular seal slidably mounted on said lead part of said valve stem downstream of said spring-engaging part and establishing a seal between said lead part of said valve stem and said bore of said housing, said first internal passage communicating with said second internal passage only downstream of said seal and upstream of said valve, an annular element which holds said valve set and is threadedly coupled to said downstream end of said gun body.

18. A spray gun comprising a gun body which includes a first inlet for receiving fluid under pressure, an outlet for discharge of said fluid, a first internal passage communicating said first inlet with said outlet, and a second inlet and a second internal passage extending from said second inlet to said outlet, said spray gun further comprising a valve upstream of said outlet to control flow of said fluid to said outlet, a valve stem for actuating said valve, and a valve stem mounting assembly comprising a housing inserted via said second inlet into said second internal passage and releasably secured therein, said housing having a bore, said valve stem having a tail part, a lead part downstream of said tail part and a spring-engaging part between said tail and lead parts, at least portions of said tail and said lead parts of said valve stem situated in said bore of said housing, a coil spring surrounding a portion of said tail part in said bore of said housing, said coil spring having a tail part coupled to said housing and a lead part coupled to said spring-engaging part of said valve stem for urging same in the downstream direction for biasing said valve to a closed state, an actuator mounted on said housing and coupled to said tail part of said valve stem for moving same in the upstream direction to selectively open said valve, an annular seal slidably mounted on said lead part of said valve stem downstream of said spring-engaging part and establishing a seal between said lead part of said valve stem and said spring, wherein the length of the valve stem downstream of said annular seal is less than the length of the valve stem upstream of said annular seal, said first internal passage communicating with said second internal passage only downstream of said seal and upstream of said valve.

19. An airless spray gun operable with a source of fluid under hydrostatic pressure, comprising a gun body which defines therein a first passageway including a first inlet and an outlet for flow of said fluid therethrough, and a second passageway which has a second inlet and communicates with said first passageway, a valve upstream of said outlet in said first passageway, a valve stem having a lead part for actuating said valve and a tail part upstream of said lead part and valve stem's tail part has a first diameter and said lead part has a second diameter greater than said first diameter with a transitional shoulder area between said tail and lead parts, and a valve stem mounting assembly comprising a housing removably secured in said second passageway, said housing having a tail part and a lead part downstream of said tail part and a central bore along its length, said valve stem extending in the upstream direction from said valve through said bore of said housing, said housing further comprising a spring coupled to said transitional shoulder area said spring engaging and urging said tail part of said valve stem in the downstream direction for closing said valve, an annular seal engaging and establishing a fluid seal between said lead part of said valve stem and said bore of said housing, and an actuator coupled to said valve stem for moving same in the upstream direction to open said valve, said first passageway intersecting said second passageway only downstream of said seal and upstream of said valve.

20. An airless spray gun operable with a source of fluid under hydrostatic pressure, comprising a gun body which defines therein a first passageway including a first inlet and an outlet for flow of said fluid therethrough, and a second passageway which has a second inlet and communicates with said first passageway, a valve upstream of said outlet in said first passageway, a valve stem having a lead part for actuating said valve and a tail part upstream of said lead part, and a valve stem mounting assembly comprising a housing removably secured in said second passageway, said housing having a tail part and a lead part downstream of said tail part and a central bore along its length defining therein a first annular recess extending radially outward of said bore in said lead part of said housing and a second annular recess extending radially outward of said bore in said tail part of said housing, said valve stem extending in the upstream direction from said valve through said bore of said housing, said housing further comprising a coil spring situated in said second recess said coil spring engaging and urging said tail part of said valve stem in the downstream direction for closing said valve, an annular seal situated in said first recess said annular seal engaging and establishing a fluid seal between said lead part of said valve stem and said bore of said housing, and an actuator coupled to said valve stem for moving same in the upstream direction to open said valve, said first passageway intersecting said second passageway only downstream of said seal and upstream of said valve.

* * * * *